US006053262A

United States Patent [19]

Ferguson et al.

[11] Patent Number: 6,053,262

[45] Date of Patent: Apr. 25, 2000

[54] HIGH-LOAD HYDRAULIC DISCONNECT

[75] Inventors: Andy Ferguson, Spring, Tex.; Randy Reich, Lafayette, La.

[73] Assignee: Baker Hughes Incorporated, Houston, Tex.

[21] Appl. No.: 09/363,157

[22] Filed: Jul. 26, 1999

Related U.S. Application Data

[62] Division of application No. 08/796,706, Feb. 6, 1997.

[51] Int. Cl.[7] ..... E21B 17/02

[52] U.S. Cl. ..... 175/321; 166/242.7; 175/320; 285/3

[58] Field of Search ..... 166/242.7, 377; 175/320, 321; 285/3, 39, 306, 307

[56] References Cited

U.S. PATENT DOCUMENTS

| | | | |
|---|---|---|---|
| 3,148,894 | 9/1964 | Schwab | 285/3 |
| 3,753,471 | 8/1973 | Kammerer, Jr. et al. . | |
| 3,842,914 | 10/1974 | Mott . | |
| 4,099,563 | 7/1978 | Hutchison et al. . | |
| 4,175,778 | 11/1979 | Nunez et al. . | |
| 4,364,587 | 12/1982 | Samford . | |
| 4,452,472 | 6/1984 | Crase . | |
| 4,531,766 | 7/1985 | Crase . | |
| 4,601,492 | 7/1986 | George . | |
| 4,915,423 | 4/1990 | Wallace . | |
| 4,984,632 | 1/1991 | Sampa et al. . | |
| 5,050,691 | 9/1991 | Moses . | |
| 5,086,843 | 2/1992 | Mims et al. . | |
| 5,219,027 | 6/1993 | Taylor . | |
| 5,224,898 | 7/1993 | Johnson et al. | 175/321 X |
| 5,267,621 | 12/1993 | Deken et al. | 175/320 X |
| 5,323,853 | 6/1994 | Leismer et al. . | |
| 5,363,921 | 11/1994 | Mendez . | |
| 5,419,399 | 5/1995 | Smith . | |
| 5,526,888 | 6/1996 | Gazewood . | |
| 5,669,455 | 9/1997 | Dietrich | 175/320 X |
| 5,787,982 | 8/1998 | Bakke . | |
| 5,839,524 | 11/1998 | Sanford | 175/320 |
| 5,857,710 | 1/1999 | Leising et al. | 175/321 X |

FOREIGN PATENT DOCUMENTS

| | | |
|---|---|---|
| 624709A2 | 11/1994 | European Pat. Off. . |
| 624709A3 | 11/1994 | European Pat. Off. . |
| 686753A2 | 12/1995 | European Pat. Off. . |
| 2303657A | 2/1997 | United Kingdom . |
| 2310872A | 9/1997 | United Kingdom . |
| WO 91/05935 | 5/1991 | WIPO . |
| WO 92/17679 | 10/1992 | WIPO . |
| WO 97/29270 | 8/1997 | WIPO . |

OTHER PUBLICATIONS

Bowen, Bowen Safety Joints, Catalog page, date unknown.

Baker Oil Tools, Fishing Services Catalog, FA/AUA Safety Hydraulic Disconnect Product No. 379–70,1995.

Dowell Schlumberger, Coiled Tubing Services Catalog, page, Release Joints, date unknown.

Baker Oil Tools, Thru–Tubing Products Technical Unit, Thru–Tubing Pull Disconnect with Bellvelle Washers for Electric Wireline Setting tools, Apr. 1994.

*Primary Examiner*—George Suchfield

*Attorney, Agent, or Firm*—Duane, Morris & Heckscher LLP

[57] ABSTRACT

The present invention provides a disconnect which has the internal integrity to make it as strong as the rest of the drill string. The present invention can disconnect when desired, despite the fact that the apparatus is at that time subjected to significant tensile or compressive loads. The invention allows for disconnection by alternative methods. Accordingly, in one version of the tool, a ball can be dropped or pumped to a seat to facilitate disconnection. In another version of the tool, that may employ an internal wireline precluding the use of a ball, disconnection can be accomplished by compression of a stack of Bellville washers, in response to a tensile force, to release a collet-locking mechanism. Either design features a rotational locking component.

6 Claims, 8 Drawing Sheets

HIGH-LOAD HYDRAULIC DISCONNECT

This application is a divisional of co-pending application Ser. No. 08/796,706, filed Feb. 6, 1997.

FIELD OF THE INVENTION

The field of this invention relates to disconnects, particularly those that can be used during drilling.

BACKGROUND OF THE INVENTION

Disconnects of various types have been used in the past in various facets of well completions. These disconnects have been used in conjunction with wireline operations, and one known type of wireline disconnect is illustrated in U.S. Pat. No. 5,363,921. Other types of disconnects, such as Bowen Safety Joints, have been used which disengage by left-hand rotation at approximately 40% of the tool's right-hand make-up torque. The problem with use of disconnects that involve shear pin or twist-to-the-left release is that they are perceived as weak and, therefore, disadvantageous for use in drilling operations. During drilling operations, reverse torques can occur, for example, as reaction forces when using a downhole motor to power a bit. Other disconnects involve the use of a tool known as a "string shot," which is positioned adjacent a portion of the string and uses explosives to loosen up a particular joint, with the intention that upon a turn to the left, the joint adjacent to where the string shot is actuated will release.

During drilling operations, known designs of disconnects have several limitations. The disconnects are perceived to be weak points in the drill string because they employ such release mechanisms as shear pins or threads that turn to the left to release. Some even advertise this weak point feature, such as the coiled tubing release joint offered by Dowell Schlumberger. During drilling operations, severe loads are placed on the drill string which can result in an inadvertent release of such known release tools; hence, they are generally not used in drilling operations. However, should problems develop during the drilling operation, it is desirable to have a disconnect to facilitate removal of the drill string so that fishing operations or milling operations can be commenced, if necessary.

One of the limitations of prior tools has been the inability to transmit torques which are frequently encountered during drilling operations. Designs that use collets are prone to failure of such locking mechanisms in the disconnect under application of severe torque.

Hydraulic disconnects have been in use in thru-tubing fishing operations. One such design is a hydraulic disconnect product No. 379-70, made by Baker Oil Tools under Model No. FA/FAU, which uses a collet to hold a joint together and a ball to move a sleeve to unsupport the collet for a release. One of the difficulties in such joints is their potential to bind if, as they are being released, there is a significant tensile or compressive load applied to the connection.

SUMMARY OF THE INVENTION

The present invention provides a disconnect which has the internal integrity to make it as strong as the rest of the drill string. The present invention can disconnect when desired, despite the fact that the apparatus is at that time subjected to significant tensile or compressive loads. The invention allows for disconnection by alternative methods. Accordingly, in one version of the tool, a ball can be dropped or pumped to a seat to facilitate disconnection. In another version of the tool, that may employ an internal wireline precluding the use of a ball, disconnection can be accomplished by compression of a stack of Bellville washers, in response to a tensile force, to release a collet-locking mechanism. Either design features a rotational locking component.

DETAILED DESCRIPTION OF THE PREFERRED EMBODIMENT

Figure 1A:
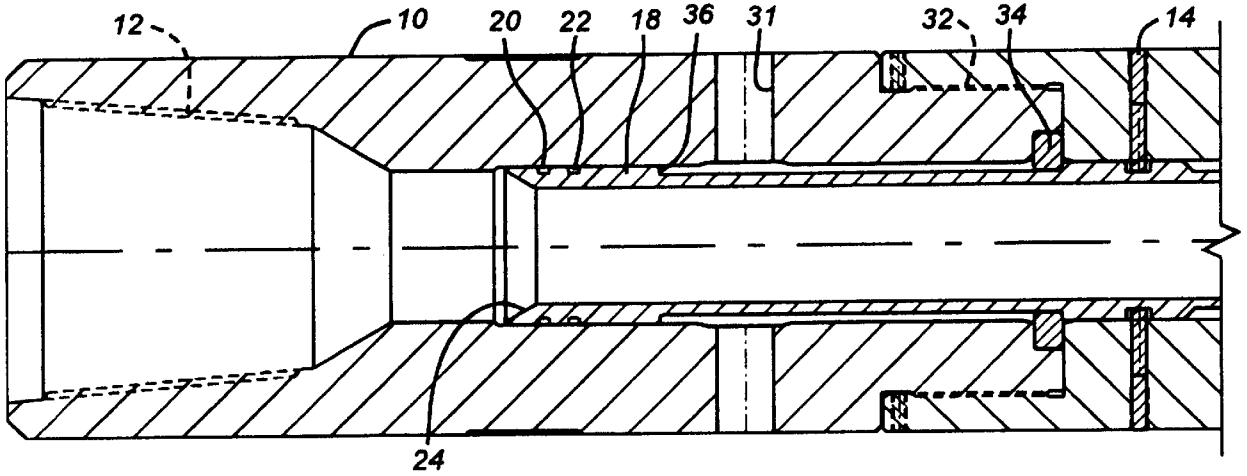
FIGS. 1*a–c* are a sectional elevational view of the disconnect in the run-in position.

Referring to FIGS. 1 *a–c*, the disconnect has a top sub 10 which can be connected to a tubing string of rigid or coiled tubing (not shown) at thread 12. A shear pin 14 holds dog housing 16 to inner sleeve 18. O-ring seals 20 and 22 seal between top sub 10 and inner sleeve 18. A ball seat 24 is formed on inner sleeve 18 to catch a ball 26 (see FIG. 2*a*) for actuation of the disconnect as will be described below. Port 31 in top sub 10 is sealingly isolated for run-in by seals 20 and 22 at the upper end of inner sleeve 18 and seals 28 and 30 at its lower end. Thread 32 connects top sub 10 to the dog housing 16.

Figure 2A:
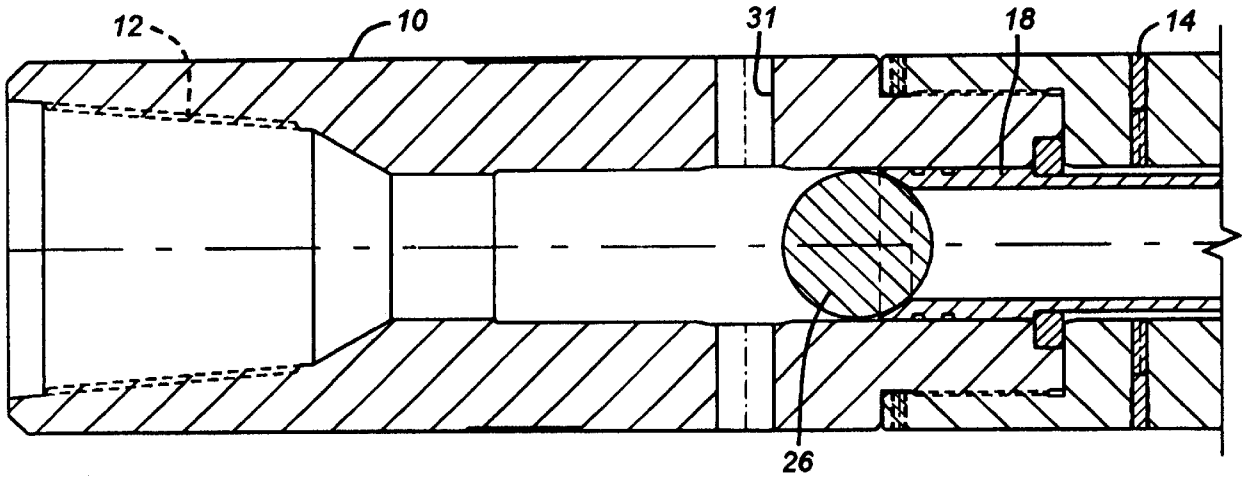
FIGS. 2*a–c* are a sectional elevational view of the disconnect of the present invention in the released position.

A split ring 34 acts as a travel stop for inner sleeve 18 when it engages shoulder 36 of inner sleeve 18, as seen in FIG. 2*a*.

Dog housing 16 has an opening 38 through which extends a series of dogs 40. A tight clearance is employed between dogs 40 and opening 38 to prevent the dogs 40 from tilting during release, which could cause a jam. The outer face 42 of each dog 40 has a thread profile to match a facing profile on latch sleeve 44. In the preferred embodiment, the thread profile is a National thread which greatly increases the bearing area of the connection and allows high tensile and compressive loads to be transmitted without failure. The flank angle of the interengaged thread combination helps to create a radial component force when an axial force is applied during disengagement. This radial force assists the dogs 40 to retract away from latch sleeve 44 upon shifting of inner sleeve 18. Latch sleeve 44 is secured to bottom sub 46 at thread 48. Dogs 50 assist in locking the latch sleeve 44 to the bottom sub 46 during fishing operations. The latch sleeve 44 has an upper end 52 which overlaps with the lower end 54 of dog housing 16. The adjuster nut 56 is connected to dog housing 16 at thread 58. Rotation of the adjuster nut 56 causes it to bear against the latch sleeve 44 for initial placement for run-in. Also, part of the lower end 54 of dog housing 16 are splines 60 which extend into matching recesses 62 in bottom sub 46. Accordingly, the dog housing 16 is rotationally locked to the bottom sub 46 by virtue of the interconnection of splines 60 into recesses 62. Other types of rotational locks can be employed without departing from the spirit of the invention. The use of splines 60 and recesses 62 allows for ultimate separation of the joint as will be described below. Additionally, the upper end 52 of the latch sleeve 44 is not physically secured to the dog housing 16 but merely overlaps it adjacent adjuster nut 56. Thus, when the dogs 40 are allowed to retract, the disconnect of the present invention comes apart, with dog housing 16 carrying out the dogs 40 as the splines 60 exit from recesses 62. The latch sleeve 44 is then left exposed for fishing operations.

The inner sleeve 18 has a recess 64 which in the run-in position is offset from the dogs 40. In the run-in position shown in FIG. 1*b*, the inner sleeve 18 forces the dogs 40 outwardly so that the thread profile 42 on the dogs 40 engages the matching profile on the latch sleeve 44. Different matching profiles or even dissimilar profiles can be used to secure the dogs 40 into latch sleeve 44. As can be seen by comparing FIG. 1*b* to FIG. 2*b*, the shifting of the inner sleeve 18 as a result of dropping a ball 26 and seating it on seat 24 and building up pressure, results in placement of the recess 64 opposite the dogs 40, allowing them to retract. The dogs 40 can be biased radially inwardly by one or more band springs 66 which are located in grooves 68 in dogs 40 (see FIG. 2*b*).

Bottom sub 46 has a port 70 in which a rupture disk 72 is mounted. In the event the central passage 74 is obstructed when it is time to position ball 26 on seat 24, pressure applied to passage 74 communicates with rupture disk 72 to break it at a predetermined pressure level to establish flow through bottom sub 46 to allow circulation from the surface to position ball 26 on seat 24.

A wear sub 76 is attached to bottom sub 46 at thread 78. Wear sub 76 has an external hard facing 80, which acts to prevent wear on the rest of the disconnect illustrated in FIGS. 1 *a–c*.

Figure 1B:
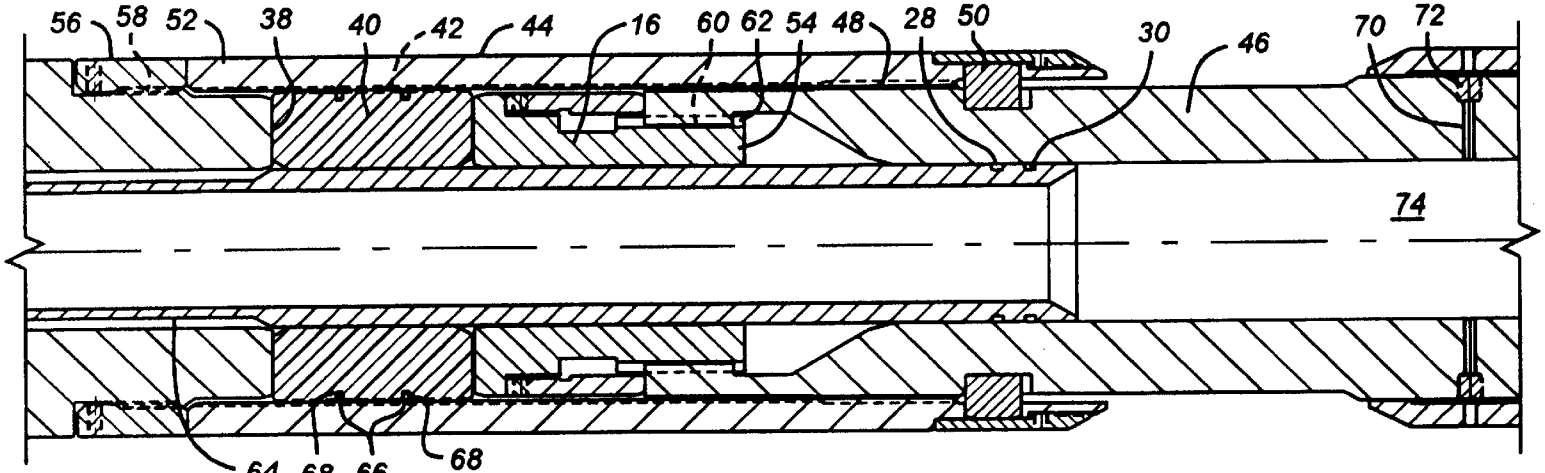
Figure 2B:
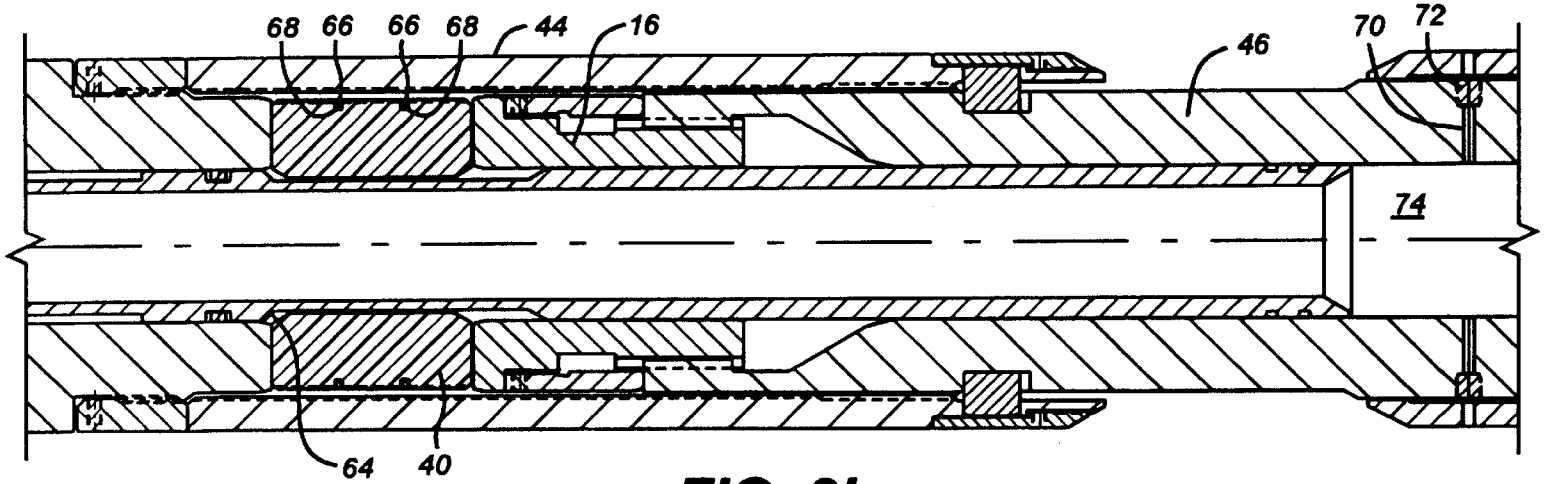
Figure 1C:
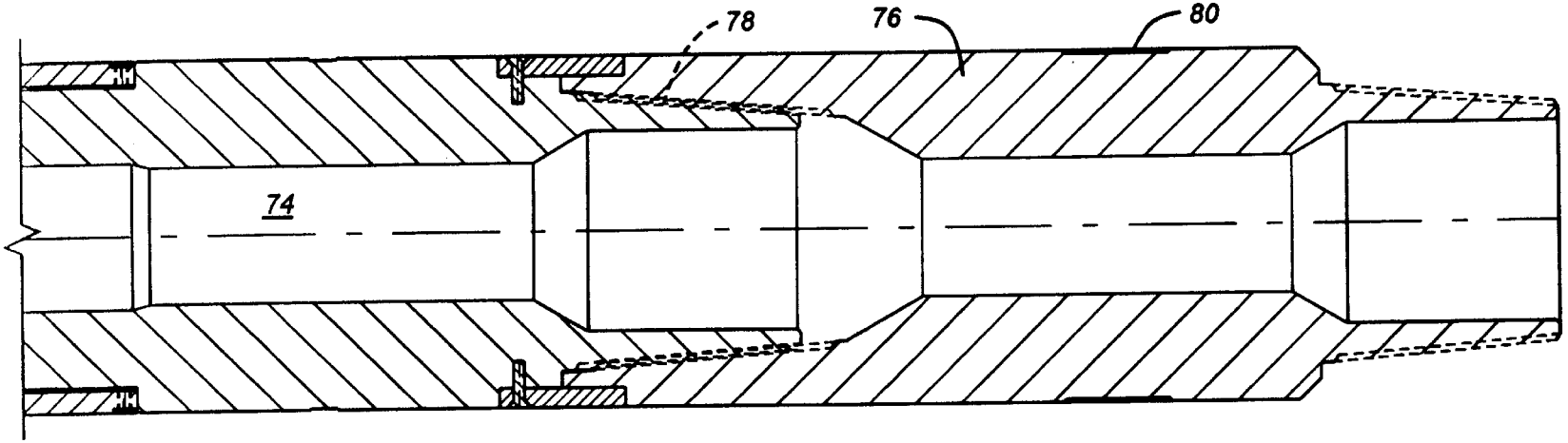
Figure 2C:
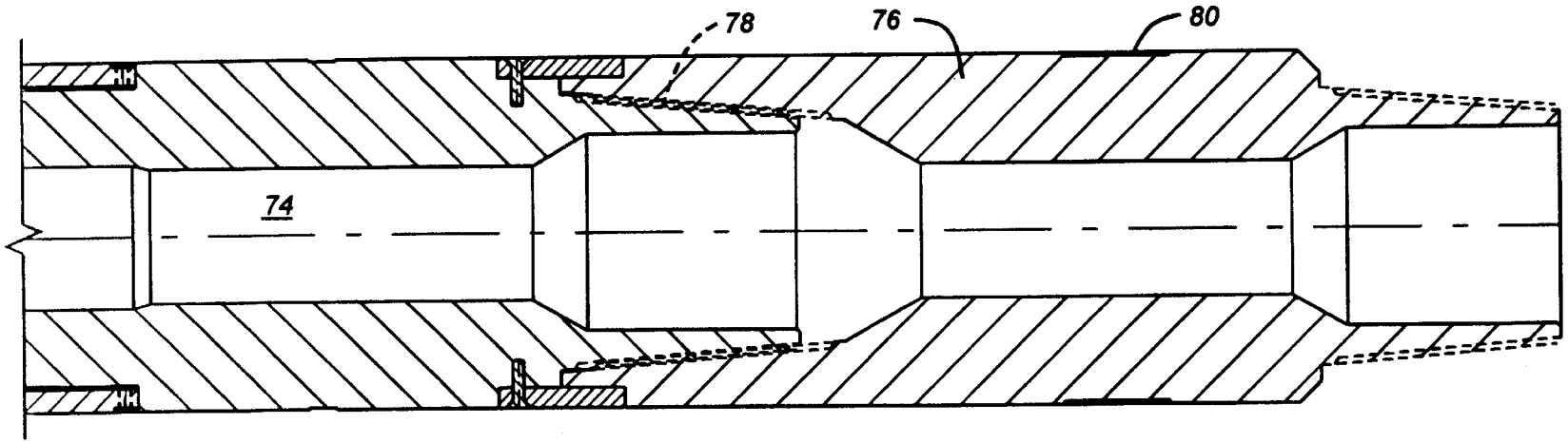
Figure 3A:
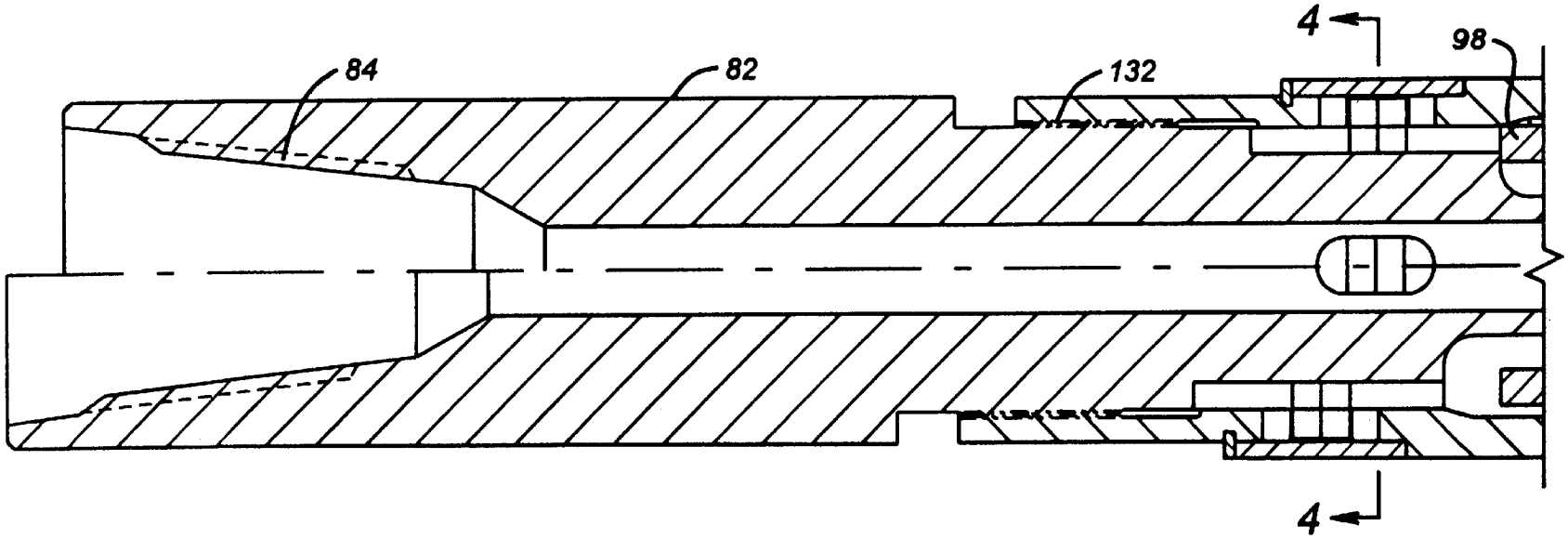
FIGS. 3*a–d* are a split view of the Bellville-type disconnect alternative embodiment shown in the connected and disconnected positions.
Figure 3B:
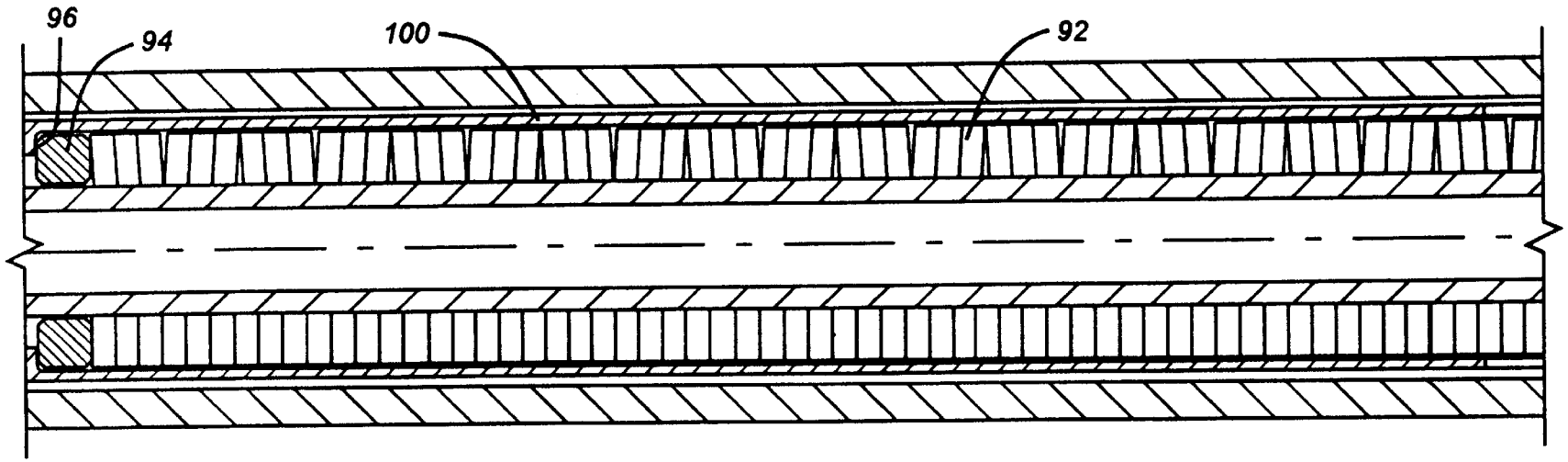
Figure 3C:
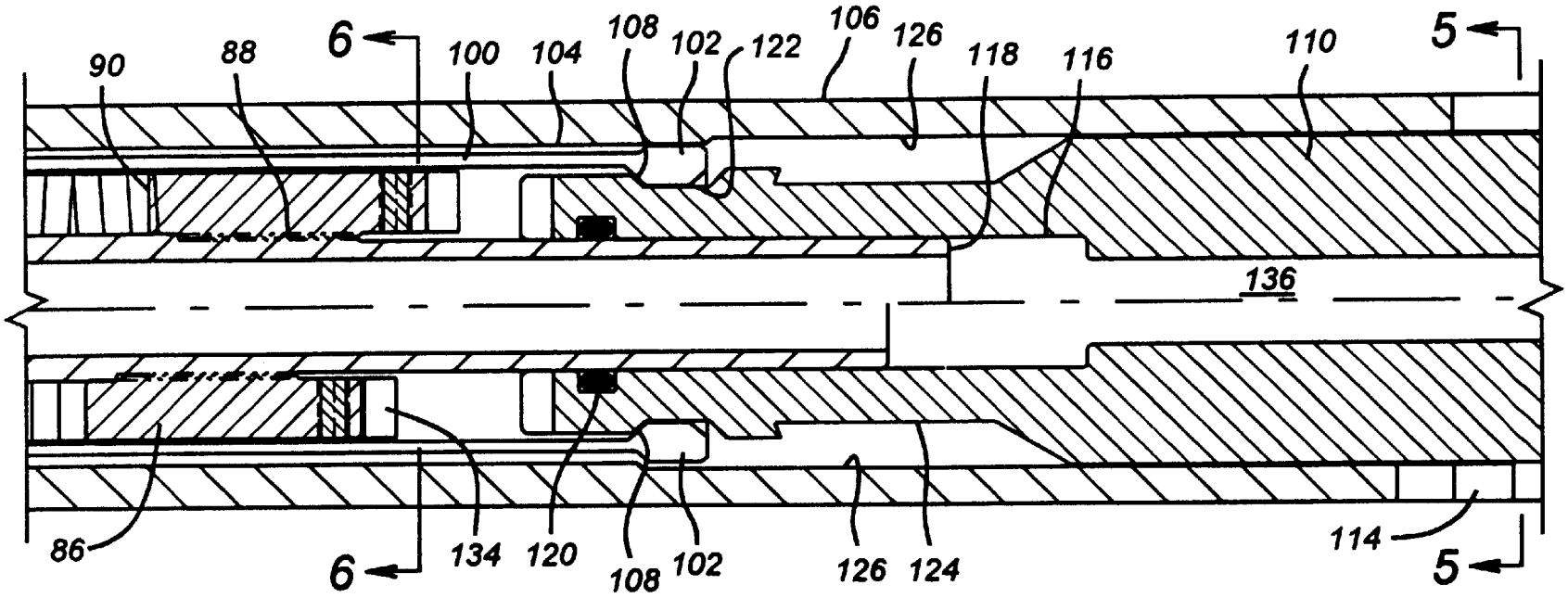
Figure 3D:
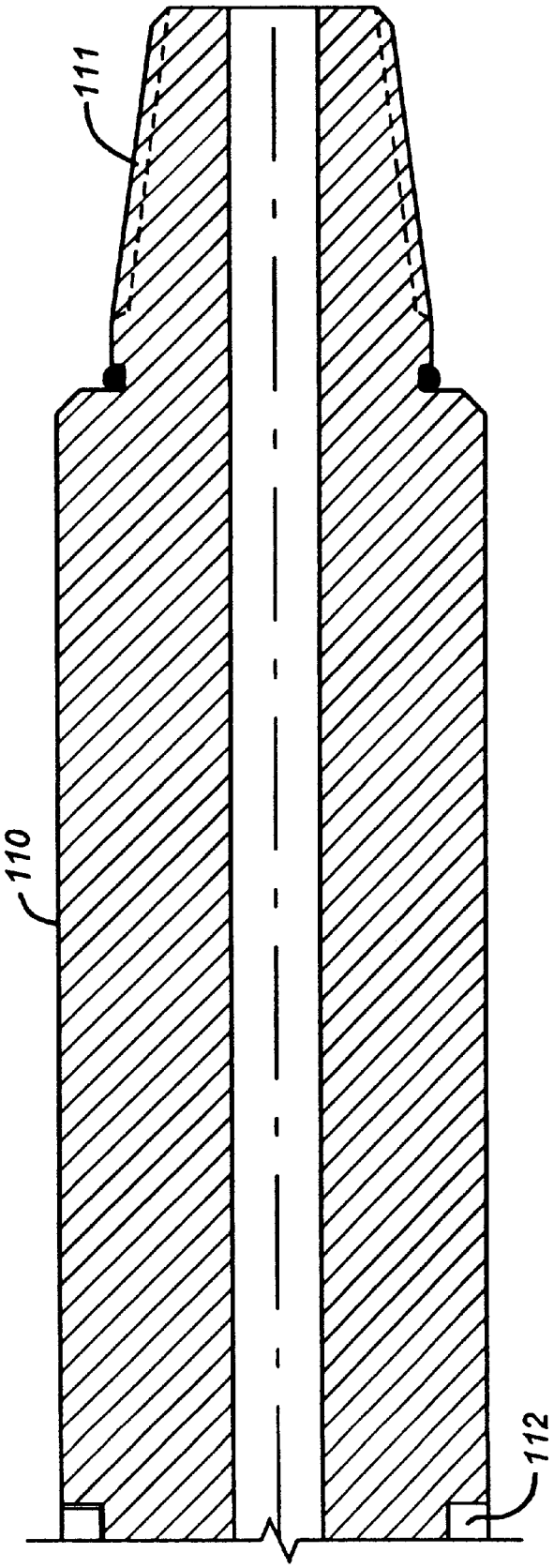
Figure 4:
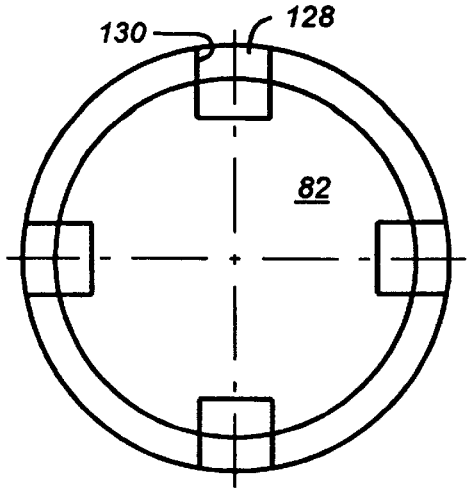
FIG. 4 is a view along section lines 4—4 of FIG. 3*a*.

When it comes time to disconnect the apparatus shown in FIGS. 1*a–c*, the ball 26 is circulated to seat 24 and pressure is built up until shear pin 14 is broken. At that time, the inner sleeve 18 slides downwardly until shoulder 36 bottoms on split ring 34. At this time, the port 31 is exposed and the operator at the surface sees a sudden pressure drop, indicating that the sleeve 18 has fully shifted, bringing recessed surface 64 in juxtaposition with the dogs 40. At that time, the band springs 66 retract dogs 40 into opening 38 in dog housing 16. An upward pull on top sub 10 brings with it dog housing 16, dogs 40, and adjuster nut 56. Left exposed for future fishing operations is latch sleeve 44. Those skilled in the art will appreciate that the configuration illustrated above, by virtue of the interengagement of the threads 42 on dogs 40 with the mating threads on latch sleeve 44, a connection at least as strong as the tubing string connection to thread 12 is provided. Accordingly, in this preferred embodiment, the operator need not be hesitant to use a disconnect, even in drilling operations for fear that the disconnect will release at an inopportune time. Thus, despite the various loadings that can occur during drilling, the disconnect as shown in FIGS. 1*a–c* and 2*a–c* reliably performs with at minimum equal strength to the remaining threaded joints in the rigid tubing string connected to thread 12.

The release as above described is possible, despite the fact that the disconnect is under a tensile or set-down load of as much as 250,000 pounds. This presents a distinct advantage to other types of prior disconnects where attempts to release, while the disconnect was under significant tensile or compressive loads, resulted in failure of some portion of the locking mechanism, which could result in the tool not releasing. The design as shown in FIGS. 1 and 2 is able to transmit torque within or exceeding the limits of the remainder of the string through the splines 60 engaged in a matching recess 62. A separation of this tool also exposes the sleeve 44, which can have a suitable recess to facilitate fishing operations. Alternatively, the bottom sub 46 can accommodate a fishing neck so that when the joint is separated and bottom sub 46 remains, the fishing operations can be facilitated.

The physical size of dogs 40 and the quantity of such dogs, as well as the nature of the exterior treatment of the dogs 40 as they engage the sleeve 44, can be configured to match or exceed the capacity of the remaining joints in the rigid tubing string which is connected to threads 12. With the apparatus as revealed in FIG. 1, a disconnect can now reliably be put in a drillstring using rigid tubing, with a release effectuated by pressure build up, coupled with the ability to transmit rotation to a level equaling or exceeding the capacity of the rigid tubing string.

The tool, as shown in FIGS. 1 and 2, can be used in coiled or rigid tubing applications. A series of such tools can be employed in a single string, with the diameter of seat 24 on each unit increasing as its position uphole increases. The advantage of multiple assemblies is that even if there is a release, the tubing can still stick. With multiple units, different disconnect points can be obtained by sequential dropping of progressively larger balls which progressively catch further uphole until eventually, the string remaining above the disconnect is no longer stuck and can be easily removed.

Figure 5:
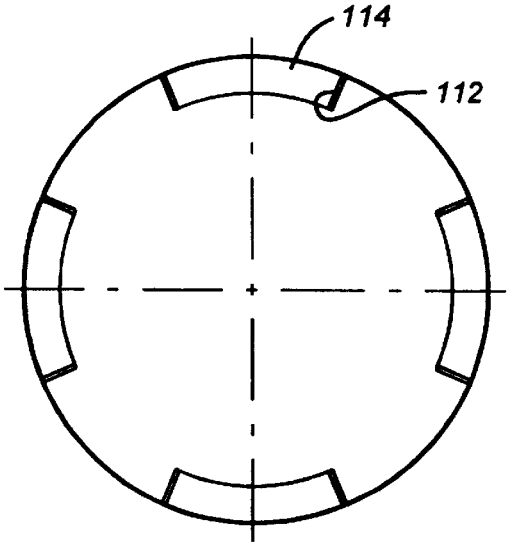
FIG. 5 is a view along section lines 5—5 of FIG. 3*b*.

FIGS. 3*a–d* illustrate an alternative embodiment which can be used instead of the preferred embodiment of FIGS. 1 and 2. There can be some applications where the central passage 74 has a wireline or other obstruction in it which precludes the mode of operation of using a ball 26 to seat on a seat 24. The alternative embodiment is shown in two positions in a split view in FIGS. 3*a–d*. It has a top sub 82 with a thread 84 to connect to the joints of tubing or coiled tubing (not shown). Ring 86 is connected to top sub 82 at thread 88. Ring 86 forms a support surface 90 onto which a stack of Bellville washers 92 is placed. A ring 94 bears on surface 96 of collet ring 98. Collet ring 98 has a series of elongated fingers 100 which terminate in collet heads 102. In the run-in position, collet heads 102 are trapped between surface 104 of outer sleeve 106 and shoulder 108 of bottom sub 110. Bottom sub 110 is a series of recesses 112 into which extend lower ends 114 of outer sleeve 106. FIG. 5 shows the lower ends 114 within recesses 112. Accordingly, there is a rotational lock between the outer sleeve 106 and the bottom sub 110. The remainder of the assembly used during drilling is connected at thread 111. This can include a downhole motor and/or a drillbit.

Bottom sub 110 has a receptacle 116 into which extends lower end 118 of top sub 82. Seal 120 seals between lower end 118 of top sub 82 and bottom sub 110. Bottom sub 110 has a groove 122 which, in conjunction with shoulder 108, retains the collet heads 102 when surface 104 on outer sleeve 106 is in contact with collet heads 102. Adjacent groove 122 is groove 124, which is useful in subsequent fishing operations after a disconnect.

The outer sleeve 106 has a recessed surface 126 adjacent surface 104. When surface 126 is juxtaposed next to the collet heads 102, they can move radially outwardly to clear shoulder 108 for a disengagement, as shown in the bottom half of FIG. 3*c*. There the collet heads 102 are no longer supported against the shoulder 108 by surface 104. Instead, surface 126 has moved into juxtaposition at the collet heads 102 as a result of an upward pull applied through the tubing string to the top sub 82 through thread 84. Such an upward pull from the surface compresses the stack of Bellville washers 92 when a predetermined force is reached, thus shortening their overall length as ring 86 moves upwardly with top sub 82.

The apparatus features additional rotational locks involving a series of lugs 128 which extend from top sub 82 into an elongated slot 130. Thus, apart from the thread connection 132 between the top sub 82 and outer sleeve 106, torque is transmitted through lugs 128 in slots 130.

Figure 6:
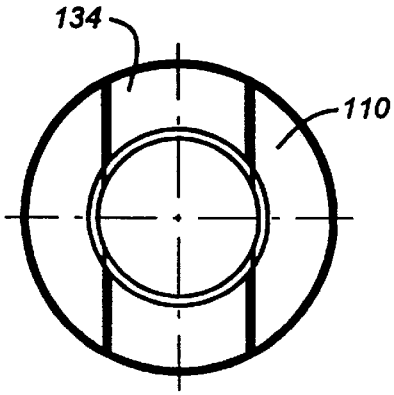
FIG. 6 is a view along section lines 6—6 of FIG. 3*c*.

As shown in FIG. 6, the bottom sub 110 can also extend sufficiently upwardly to engage extending segments 134 of ring 86 to facilitate torque transmission by locking the top sub 82 to the bottom sub 110.

In operation, the disconnected position in FIG. 3 is reached by an upward pull on top sub 82, which urges ring 86 upwardly against the stack of Bellville washers 92. When the stack compresses, the outer sleeve 106 rides up to position surface 126 adjacent the collet heads 102, at which point the upward force applied to top sub 82 disconnects the top sub 82 from the bottom sub 110. This embodiment can also be used in drilling. Because of the fact that it uses collets 102 as a locking mechanism, the disconnect shown in FIG. 3 can be perceived as not as strong as any other component of a rigid tubing string used during drilling operations. The torque that can be transmitted through the top sub 82 to the bottom sub 110 meets or exceeds the torque limitations of the remainder of the string. Such torque is not transmitted through the collets 102. This embodiment can be used when a wireline extends through the central passage 136 and the preferred embodiment of FIGS. 1 and 2 cannot be used due to the wireline.

The foregoing disclosure and description of the invention are illustrative and explanatory thereof, and various changes in the size, shape and materials, as well as in the details of the illustrated construction, may be made without departing from the spirit of the invention.

What is claimed is:

1. A disconnect assembly for a tubing string, used during drilling with a bit, comprising:

a tubing string with a bit connected thereto;

a disconnect comprising an upper body and a lower body, with each connected on one end to a portion of said tubing string and on an opposite end releasably secured to each other;

said upper and lower bodies secured to each other by a trapped locking member which releases upon a predetermined relative movement between said upper and lower bodies initiated by a force which overcomes a biasing member acting on said locking member.

2. The assembly of claim 1, wherein:

said upper and lower bodies are rotationally locked to each other.

3. The assembly of claim 2, wherein:

said biasing member comprises at least one spring;

said locking member comprises at least one collet;

whereupon application of said force to said upper body, said spring is compressed, which allows said collet to release said upper and lower bodies.

4. The assembly of claim 3, wherein:

said spring comprises a stack of Bellville washers;

said locking member comprises a plurality of collets.

5. The assembly of claim 3, wherein:

said rotational locking is accomplished by interengaging components of said upper and lower body in a manner where applied torque does not transfer through said collet.

6. The assembly of claim 3, wherein:

said upper and lower bodies having a flowpath therethrough and selectively disengageable from each other, even with an object such as a wireline extending through said towpath.

* * * * *